US007901472B2

(12) United States Patent
Perry

(10) Patent No.: US 7,901,472 B2
(45) Date of Patent: Mar. 8, 2011

(54) COMBUSTION MODIFIER AND METHOD FOR IMPROVING FUEL COMBUSTION

(75) Inventor: Stephen C. Perry, Norwood, MA (US)

(73) Assignee: ConSeal International Incorporated, Norwood, MA (US)

( * ) Notice: Subject to any disclaimer, the term of this patent is extended or adjusted under 35 U.S.C. 154(b) by 690 days.

(21) Appl. No.: 11/846,994

(22) Filed: Aug. 29, 2007

(65) Prior Publication Data

US 2009/0056207 A1 Mar. 5, 2009

(51) Int. Cl.
*C10L 1/30* (2006.01)

(52) U.S. Cl. ..... 44/603; 44/314; 44/358; 44/361; 44/363

(58) Field of Classification Search ..... 44/603; 585/14

See application file for complete search history.

(56) References Cited

U.S. PATENT DOCUMENTS

| | | | | |
|---|---|---|---|---|
| 2,763,617 | A * | 9/1956 | Roddick et al. | 508/185 |
| 3,285,946 | A * | 11/1966 | De Witt et al. | 556/143 |
| 4,264,335 | A * | 4/1981 | Bello et al. | 44/364 |
| 4,389,220 | A | 6/1983 | Kracklauer | |
| 4,522,631 | A * | 6/1985 | Mourao et al. | 44/364 |
| 4,568,357 | A * | 2/1986 | Simon | 44/364 |
| 5,234,475 | A | 8/1993 | Malhotra et al. | |
| 5,235,936 | A | 8/1993 | Kracklauer | |
| 5,331,994 | A | 7/1994 | Bryan, III et al. | |
| 6,523,503 | B1 | 2/2003 | Kracklauer | |
| 7,169,196 | B2 | 1/2007 | Wakefield | |
| 2003/0084858 | A1 | 5/2003 | Kracklauer | |
| 2005/0081430 | A1 | 4/2005 | Carroll et al. | |
| 2005/0164139 | A1 * | 7/2005 | Valentine et al. | 431/4 |

FOREIGN PATENT DOCUMENTS

| | | |
|---|---|---|
| EP | 1512736 | 3/2005 |
| WO | 9936488 | 7/1999 |
| WO | WO2007062330 A1 | 5/2007 |

OTHER PUBLICATIONS

Krishanan Venkatasubbaiah et al. ,Reversible Expansion and Contraction of a 1,2-Diborylated Ferrocene Dimer Promoted by Redox Chemistry and Nucleophile Binding, 2005, Angew. Chem. Int. 2005, 44, 5428-5433.*

M. Herberhold et al., Dynamic Behavior of some boryl-substituted ferrocenes, 1995, Polyhedron, vol. 14, No. 19,, pp. 2683-2689.*

* cited by examiner

*Primary Examiner* — Ellen M McAvoy
*Assistant Examiner* — Ming Cheung Po
(74) *Attorney, Agent, or Firm* — James David Johnson

(57) ABSTRACT

A composition for improving the combustion efficiency of an internal combustion Engine. The composition includes a mixture of a hydrocarbon fuel and an organometallic soap selected from among several cerium-containing and ferric compounds. The cerium-containing compound or compounds increase the energy released during combustion of the fuel. The ferric compound or compounds coat an interior wall of a combustion chamber of the internal combustion engine to increase the power output of the engine by reducing the accumulation of residues deposited on the interior wall which interfere with the combustion of fuel.

17 Claims, 4 Drawing Sheets

COMBUSTION MODIFIER AND METHOD FOR IMPROVING FUEL COMBUSTION

FIELD OF THE INVENTION

The invention relates to fuel combustion. More particularly, the invention relates to combustion modifier compositions and methods for improving the combustion efficiency of a vehicle by increasing the efficiency of the internal combustion engine in combusting hydrocarbon fuels.

BACKGROUND

Soaring fuel costs, peaking fuel production and dwindling reserves, conservation efforts, and environmental concerns have increased public awareness of the fuel efficiency issues posed by automobiles and other vehicles. Internal combustion engines are often inefficient in combusting fuel in that they fail to completely burn all of the fuel entering a combustion chamber of the engine. This unburned fuel can remain within the combustion chamber where it forms unburned hydrocarbon residues that accumulate on an interior wall of the combustion chamber as well as other surfaces that play a role in the combustion process. These residues are problematic because, when incinerated, they are discharged as toxic and harmful exhaust emissions such as soot. These unburned hydrocarbons may also react with nitrogen oxides, which are also produced during fuel combustion, upon exposure to ultraviolet light to form ozone. The unburned hydrocarbon residues interfere with fuel combustion and reduce the power output of the engine. Additionally, with the present low levels of sulfur in fuels, the internal combustion engine and its parts such as the exhaust valve experience additional friction that was reduced by the lubricating effects of the sulfur previously found in most hydrocarbon fuels.

Conventional fuel additives may also be disadvantageous due to the necessity of including a carrier or substrate that may permit the active ingredients of those products to attach to the interior surface of the combustion chamber of the internal combustion engine. Carriers and substrates in these conventional fuel additives may include toxic compounds that increase production costs and harm the environment when emitted in vehicle exhaust emissions. The failure of many conventional fuel additives to coat the combustion chamber's interior surface to prevent the formation and accumulation of residues thereon decreases the efficiency of the engine in combusting fuel. Less fuel is combusted by the engine and more fuel is wasted as combustion by-product residues that are deposited onto the interior surface of the combustion chamber.

Another disadvantage of conventional fuel additives is that many include precious metals such as platinum to act as catalysts. The use of catalytically-active precious metals is undesirable due to the high costs of production of such fuel additives.

An additional disadvantage of conventional fuel additives is that many are water soluble and cannot be dissolved in oil. The insolubility of many conventional fuel additives in oil reduces the effectiveness of the fuel additives in improving fuel efficiency. Oil-insoluble conventional fuel additives must be mixed with an oil-soluble compound prior to use, thereby increasing the cost of production. Conventional fuel additives may also include other environmentally-harmful compounds, such as naphthalene, which may be toxic to animals, plants, humans, and other organisms.

Another disadvantage of many conventional fuel additives is their failure to reduce the emissions of volatile organic compounds (VOCs) and nitrogen oxides in vehicle exhaust, which are produced as byproducts of fuel combustion. Both VOCs and nitrogen oxides undergo a chemical reaction in the lower atmosphere upon exposure to ultraviolet light to form ozone, which is a hazardous smog-forming pollutant that has been linked to respiratory illnesses and lung tissue damage in humans.

Conventional fuel additives have not included a source of boron because many boron-containing compounds create a thin layer of boron oxide that deposits on the combustion surfaces of an internal combustion engine. This thin layer of boron oxide produces longer ignition delays, and thus, reduces combustion efficiency.

Conventional fuel additives have also not included a source of cerium because most conventional fuel additives work as detergents or solvents to physically affect fuel in an effort to increase the efficiency of combustion. In addition, many cerium-containing compounds have proven difficult or disadvantageous for usage in fuel additives, and thus, have been avoided by the makers of conventional fuel additives, due to the undesirable byproducts precipitated from ceric salts and cerous salts used to produce cerium metal. Ceric salts that are undesirable for producing cerium metal to be used in fuel additives include ceric fluoride, ceric oxide, and ceric sulfate. Cerous salts that are undesirable for producing cerium metal to be used in fuel additives include cerous bromide, cerous carbonate, cerous chloride, cerous fluoride, cerous iodide, cerous nitrate, cerous oxalate, and cerous sulfate. These ceric and cerous salts are not solvent-soluble and do not yield cerium metal with a high level of purity. Cerium metal derived from these ceric and cerous salts is not oil-soluble and must be finely ground into nanoparticles and complexed with a fuel-soluble compound before introduction into an internal combustion engine. The production of nanoparticles of cerium metal would greatly increase the costs of producing cerium-containing fuel additives using conventional technologies.

SUMMARY

The present invention relates to the discovery that certain organometallic soaps, when added to fuel, achieve several advantageous effects with respect to the combustion of fuel in an internal combustion engine. These organometallic soaps, which are soluble in fuel products derived from petroleum oil as well as in other hydrocarbon fuels, may contain ferric iron or cerium (III). The organometallic soap or soaps can be selected from among the following ferric and cerous compounds: cerium ammoniate, cerium ureate, cerium nitrate, cerium-2-ethylhexanoate, cerium octoate, cerium stearate, cerium naphthenate, cerium salicylate, cerium carbonate, ferric octoate, ferric-2-ethylhexanoate, ferric stearate, ferric naphthenate, ferric salicylate, ferric carbonate, diborylated ferrocene, n-butyl ferrocene, 1,1'-dimethyl ferrocene, benzoyl ferrocene, and combinations thereof. Each organometallic soap, alone or in combination with one or more other organometallic soaps, can be used as a combustion modifier that can be introduced into the internal combustion engine to increase the engine's fuel combustion efficiency.

The ferric compounds increase the efficiency of fuel combustion in internal combustion engines by creating a catalytic residue that coats an interior surface of the engine's combustion chamber. Upon combustion, diborylated ferrocene, for example, forms an iron-boron complex catalytic coating on the interior surface of the combustion chamber to create a sacrificial catalytic coating. The catalytic coating formed by the diborylated ferrocene, which is a fullerene, prevents faulty combustion caused by the accumulation of carbon deposits on the interior surface of the combustion chamber. The ferric compounds, and diborylated ferrocene in particular, also act as lubricants to replace the lubricating effect lost by the reduction of sulfur content in low-sulfur diesel fuels. The lubricating effect of the combustion modifier reduces wear of the exhaust valve seat. Like the lead that was formerly present in some fuels, the ferric compound of the combustion modifier can replace the anti-knocking effects now lost in unleaded fuels. The ferric compound of the combustion modifier can act as an anti-knocking agent to reduce or eliminate engine "knocking." By increasing the efficiency of the internal combustion engine in combusting fuel, the ferric compound of the combustion modifier also increases engine power, which, in turn, enhances the torque and fuel economy of the engine.

Diborylated ferrocene, in particular, is advantageous for use as the ferric compound in the combustion modifier. The compound includes at least one diboryl ring and at least two ferrocene units. Advantages are derived from boron's low molecular weight and high energy of combustion, which make boron an attractive additive for use in high-energy fuels such as rocket propellants. When complexed with an iron compound as in, for example, diborylated ferrocene, the boron does not produce a boron oxide layer on the combustion surfaces of the internal combustion engine thereby eliminating any negative effects produced by the formation of such a layer. In addition, the catalytic coating created by the boron-iron complex is a far superior catalyst in comparison to either an iron coating or a boron coating individually.

Diborylated ferrocene is a stable, neutral fullerene structure compound. The diborylated ferrocene dimer is able to undergo reversible conformational changes promoted by both reduction and oxidation (redox) reactions when exposed to combustion of the fuels to which it is added. Diborylated ferrocene exhibits strong boron-iron electronic interactions, and when exposed to combustion temperatures, it can undergo reduction at the diboryl ring or oxidation at the ferrocene unit. The diboryl ring sits slightly tilted in a plane between the ferrocene molecules, however, when the diborylated ferrocene is oxidized or reduced, the diboryl ring flattens in the plane. This flattening effect pushes the iron atoms of the ferrocene molecules farther apart and makes available the advantageous catalytic features inherent to both the ferrocene molecule and the boron molecule.

The cerous compounds act as catalytic oxidizers to quicken the combustion rate of the fuel in the internal combustion engine. The cerous compounds achieve this effect by exciting fuel molecules to move farther apart from one another thereby producing smaller fuel droplets. By increasing the surface-to-volume ratio of the fuel, the smaller fuel droplets combust more quickly and efficiently than fuel that does not contain the composition. The cerous compounds also reduce the ignition delay, which is the time elapsing between the application of a spark and the combustion of the fuel. Addition of one or more of the cerous compounds to the composition can reduce the ignition delay for fuel to which the composition has been added by about 1 to 4 milliseconds.

The present methods for making cerium-containing compounds is advantageous because the cerous compounds produced by these methods are reactant and oil-soluble and do not require grinding to produce fine, nanosized particles that must be complexed with fuel-soluble compounds. By eliminating the need to produce nanoparticles of cerium, the present methods reduce the cost of production of cerous combustion modifier compounds. Cerous nitrogen-containing compounds, e.g., cerium ureate, cerium ammoniate, and cerium nitrate, can be used in combination with fuel to modify the fuel's combustion rate. The cerous compounds produced by these methods can include nitrate, ammonia, or urea to enhance the combustion rate of fuel, thereby increasing fuel efficiency and reducing the production of nitrogen oxides from nitrogen compounds present in the fuel.

The organometallic soap can be mixed with a hydrocarbon fuel to improve the efficiency of the internal combustion engine, and in particular, the internal combustion engine of a vehicle, in combusting hydrocarbon fuels. For example, the organometallic soap and fuel mixture may increase the rate of fuel combustion in the engine and improve the efficiency of the engine in generating power. In one example, the combustion efficiency of an internal combustion engine increased almost 40 percent with the addition of the organometallic soap to fuel supplied to the engine for combustion. The organometallic soaps of this invention also coat the interior surface of the combustion chamber and other combustion parts of the internal combustion engine to reduce the accumulation of carbon residues therein. The mixture of fuel and organometallic soaps may also act to reduce toxic emissions released in exhaust fumes produced by the engine. Use of the composition by introduction into the internal combustion engine significantly increases combustion efficiency by increasing the amount of fuel combusted by the engine and by reducing the amount of fuel that fails to fully combust inside the engine. The composition may also reduce the accumulation of carbon residues, including soot, by preventing their deposition on the interior surface of the combustion chamber during the breakdown of hydrocarbon fuels.

The production of pollutants, including nitrogen oxides and VOCs, can also be reduced by the use of organometallic soaps. The combustion modifier may act to reduce the production of these compounds by improving the efficiency of fuel combustion so that less waste products are generated and also by incorporating a nitrogen-containing component such as cerium ammoniate or cerium ureate. By reducing the production of these waste products of inefficient fuel combustion, the combustion modifier also indirectly reduces the formation of ozone in the atmosphere by decreasing the emissions of ozone's precursor chemicals, e.g., VOCs and nitrogen oxides.

In comparison with conventional fuel additives, the organometallic soaps of this invention also present a significant advantage over many conventional fuel additives due to the solubility of the organometallic soaps in oil.

Accordingly, the invention features a composition for improving the combustion efficiency of an internal combustion engine in combusting hydrocarbon fuels. The composition may include a hydrocarbon fuel and a combustion modifier. The combustion modifier can include an organometallic soap selected from the group consisting of: cerium-2-ethylhexanoate, cerium octoate, cerium stearate, cerium naphthenate, cerium salicylate, cerium carbonate, cerium ammoniate, cerium ureate, cerium nitrate, ferric octoate, ferric-2-ethylhexanoate, ferric stearate, ferric naphthenate, ferric salicylate, ferric carbonate, diborylated ferrocene, n-butyl ferrocene, 1,1'-dimethyl ferrocene, benzoyl ferrocene, and combinations thereof.

In another aspect, the invention features as the organometallic soap a compound selected from the group consisting of: cerium octoate, cerium ammoniate, cerium ureate, and cerium-2-ethylhexanoate.

In another aspect, the invention features diborylated ferrocene as the organometallic soap.

In another aspect, the invention features as the combustion modifier a mixture of diborylated ferrocene and a compound selected from the group consisting of: cerium-2-ethylhexanoate and cerium octoate.

In another aspect, the invention features as the combustion modifier a mixture of diborylated ferrocene and a compound selected from the group consisting of: cerium ammoniate and cerium ureate.

In another aspect, the invention features as the combustion modifier diborylated ferrocene in the range of 10 to 100 percent by weight.

In another aspect, the invention features as the combustion modifier cerium-2-ethylhexanoate in the range of 10 to 100 percent by weight.

In another aspect, the invention features as the combustion modifier a mixture of diborylated ferrocene and cerium-2-ethylhexanoate wherein one of the compounds comprises 10 to 100 percent by weight of the combustion modifier with the other compound forming the remaining balance.

In another aspect, the invention features as the combustion modifier a mixture of 70 percent by weight diborylated ferrocene and 30 percent by weight cerium-2-ethylhexanoate.

In another aspect, the invention features as the combustion modifier a mixture of diborylated ferrocene at 70 percent by weight and 30 percent by weight of an organometallic soap selected from the group consisting of cerium ammoniate and cerium ureate.

In another aspect, the invention features the combustion modifier as a liquid.

In another aspect, the invention features the organometallic soap dissolved in a solvent blend comprising Solvent 142, dibasic ester, and propylene glycol mono-n-butyl ether.

In another aspect, the invention features as the combustion modifier a mixture of about 4 percent by weight organometallic soap, about 81 percent by weight Solvent 142, about 10 percent by weight dibasic ester, and about 5 percent by weight propylene glycol mono-n-butyl ether.

In another aspect, the invention features as the combustion modifier a mixture of diborylated ferrocene at 40 to 60 percent by weight and a cerous compound at 40 to 60 percent by weight wherein the cerous compound is selected from one of the group consisting of cerium ammoniate and cerium ureate.

The invention also features a method which includes the step of introducing into an internal combustion engine a hydrocarbon fuel and a combustion modifier. The combustion modifier of the method includes an organometallic soap selected from the group consisting of: cerium-2-ethylhexanoate, cerium octoate, cerium stearate, cerium naphthenate, cerium salicylate, cerium carbonate, cerium ammoniate, cerium ureate, cerium nitrate, ferric octoate, ferric-2-ethylhexanoate, ferric stearate, ferric naphthenate, ferric salicylate, ferric carbonate, diborylated ferrocene, n-butyl ferrocene, 1,1'-dimethyl ferrocene, benzoyl ferrocene, and combinations thereof.

Another method of the invention includes the step of supplying the combustion modifier into a fuel tank, which is connected to the internal combustion engine, in an amount of about 0.01 to 5 grams per about 20 gallons of fuel.

Another method of the invention includes the step of supplying the combustion modifier into a fuel tank, which is connected to the internal combustion engine, in an amount of about 0.01 to 3 grams per about 20 gallons of fuel Another method of the invention includes the step of supplying the combustion modifier into a fuel tank, which is connected to the internal combustion engine, in an amount of about 0.25 to 1 gram per about 20 gallons of fuel.

The invention further features a method for producing a combustion modifier that includes the steps of: (a) mixing a cerium compound with a first acid and with a compound selected from the group consisting of: a salt of a second acid, an ester of the second acid, a salt of urea, an ester of urea, a salt of ammonia, and an ester of ammonia, to produce a mixture; (b) heating the mixture while placing the mixture under pressure less than standard atmospheric pressure; (c) heating the mixture while placing the mixture under pressure of about 30 inches of mercury; and (d) cooling the mixture to yield a combustion modifier.

Another method of the invention includes the step of selecting and using a synthetic mono-carboxylic acid as the first acid.

Another method of the invention includes the step of adding a ferric organometallic soap to the mixture before step (c) of the method.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1A:
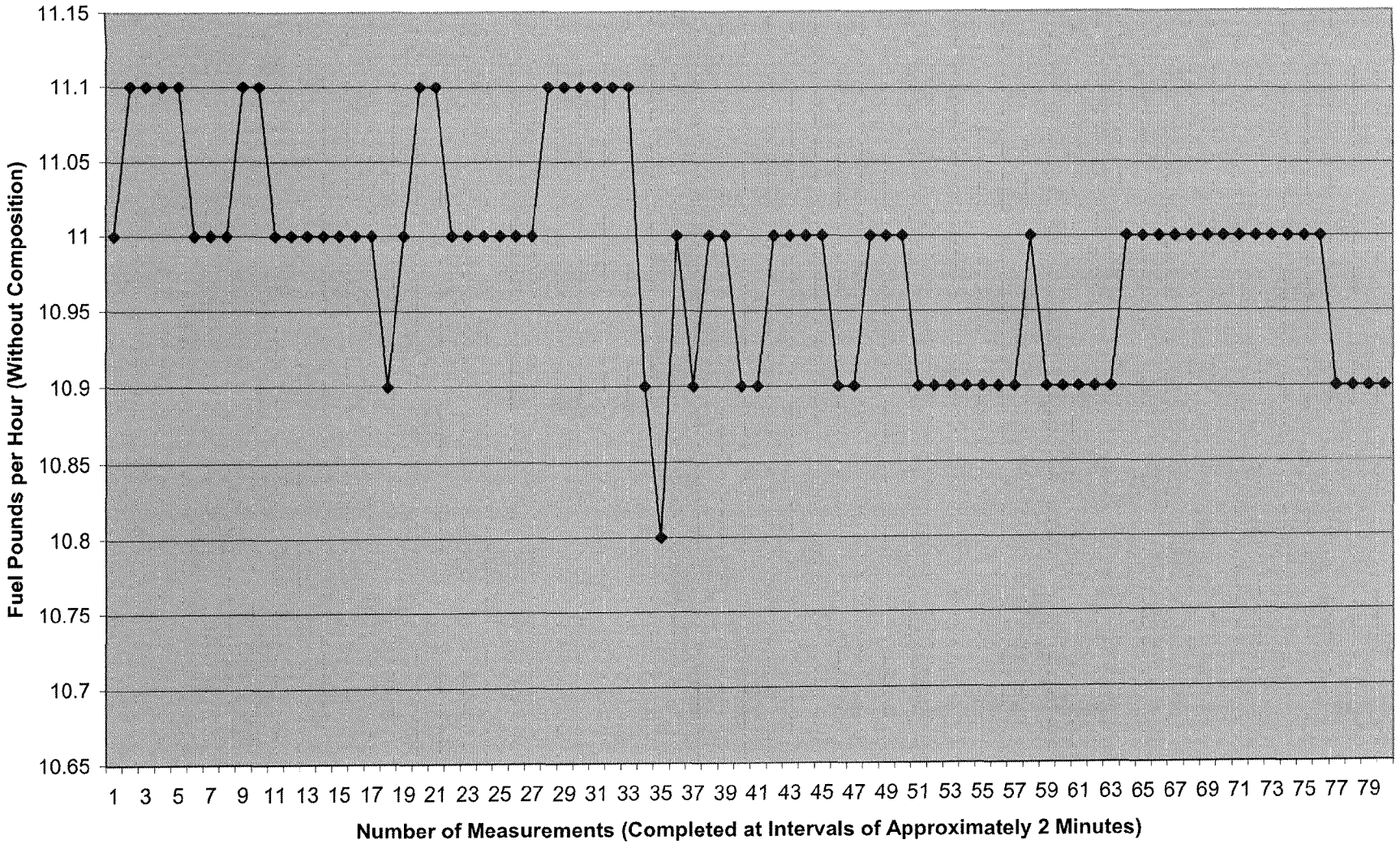
FIG. 1A is a chart representing fuel pounds per hour measurements for a control test in which diesel fuel was combusted in an internal combustion engine without the addition of a combustion modifier of the invention.

The invention provides a composition for improving the combustion efficiency of an internal combustion engine, and in particular, the internal combustion engine of a vehicle, in combusting hydrocarbon fuels. The composition includes a mixture of a hydrocarbon fuel and a combustion modifier that contains an organometallic soap. The organometallic soap may contain ferric iron or cerium (III). The organometallic soap of the combustion modifier can be selected from among the following ferric and cerous organometallic soap compounds: cerium ammoniate, cerium ureate, cerium nitrate, cerium-2-ethylhexanoate, cerium octoate, cerium stearate, cerium naphthenate, cerium salicylate, cerium carbonate, ferric octoate, ferric-2-ethylhexanoate, fenic stearate, ferric naphthenate, ferric salicylate, ferric carbonate, diborylated ferrocene, n-butyl ferrocene, 1,1'-dimethyl ferrocene, benzoyl ferrocene, and combinations thereof. The combustion modifier can include 1, 2, 3, 4, 5, or more of the organometallic soaps. The organometallic soap is soluble in fuel products derived from petroleum oil as well as in other hydrocarbon fuels.

Hydrocarbon fuels with which the combustion modifier can be mixed include, for example, (1) petroleum-derived fossil fuels such as gasoline, diesel, jet fuel, fuel oil, and kerosene; (2) biofuels such as bioethanol, biodiesel, straight vegetable oils (pure plant oils), and waste vegetable oils; and (3) combinations thereof.

In one embodiment, the organometallic soap can be diborylated ferrocene only although the combustion modifier preferably also contains a cerous compound for increasing the combustion rate of the fuel in the internal combustion engine. In another embodiment of the composition, the combustion modifier may include only a single ferric iron-containing organometallic soap selected from among those described herein.

In another embodiment, the organometallic soap can be cerium-2-ethylhexanoate only although the combustion modifier preferably also contains a ferric compound for increasing the combustion rate of the fuel in the internal combustion engine by preventing the accumulation of carbon residues on the internal surface of the combustion chamber of the internal combustion engine. In another embodiment of the composition, the combustion modifier may include only a single cerium-containing organometallic soap selected from among those described herein.

In another embodiment, the combustion modifier can include a mixture of one or more ferric compounds selected from among those described herein and one or more cerous compounds selected from among those described herein. The combustion modifier may include the ferric compound or mixture of compounds in a range of about 10 to 100 percent by weight or about 60 to 80 percent by weight and the cerous compound or mixture of compounds in a range of about 10 to 100 percent by weight or about 20 to 40 percent by weight. The combustion modifier can also include the ferric compound or mixture of compounds in a range of about 15 to 85, about 35 to 75, or about 65 to 75 percent by weight and the cerous compound or mixture of compounds in a range of about 15 to 85, about 25 to 65, or about 25 to 35 percent by weight. The combustion rate and combustion efficiency are most improved when the combustion modifier contains about 70 percent by weight ferric compound or compounds and about 30 percent by weight cerous compound or compounds.

In another embodiment, the combustion modifier can include a mixture of n-butyl ferrocene, 1,1'-dimethyl ferrocene, or benzoyl ferrocene and one or more cerous compounds selected from among those described herein. The combustion modifier may include at least one of n-butyl ferrocene, 1,1'-dimethyl ferrocene, or benzoyl ferrocene in a range of about 10 to 100 percent by weight or about 60 to 80 percent by weight and the cerous compound or mixture of compounds in a range of about 10 to 100 percent by weight or about 20 to 40 percent by weight. The combustion modifier can also include at least one of n-butyl ferrocene, 1,1'-dimethyl ferrocene, or benzoyl ferrocene in a range of about 15 to 85, about 35 to 75, or about 65 to 75 percent by weight and the cerous compound or mixture of compounds in a range of about 15 to 85, about 25 to 65, or about 25 to 35 percent by weight. The combustion rate and combustion efficiency are most improved when the combustion modifier contains about 70 percent by weight of at least one of n-butyl ferrocene, 1,1'-dimethyl ferrocene, or benzoyl ferrocene and about 30 percent by weight cerous compound or compounds.

In another embodiment, the combustion modifier can include a mixture of cerium-2-ethylhexanoate and diborylated ferrocene. In this embodiment, the combustion modifier may include diborylated ferrocene in a range of about 10 to 100 percent by weight or about 60 to 80 percent by weight and cerium-2-ethylhexanoate in a range of about 10 to 100 percent by weight or about 20 to 40 percent by weight. The combustion modifier can also include diborylated ferrocene in a range of about 15 to 85, about 35 to 75, or about 65 to 75 percent by weight and cerium-2-ethylhexanoate in a range of about 15 to 85, about 25 to 65, or about 25 to 35 percent by weight. The combustion rate and combustion efficiency are most improved when the combustion modifier contains about 70 percent by weight diborylated ferrocene and about 30 percent by weight cerium-2-ethylhexanoate.

In a preferred embodiment, the combustion modifier can be a mixture of diborylated ferrocene and cerium octoate. In this embodiment, the combustion modifier may include diborylated ferrocene in a range of about 10 to 100 percent by weight or about 60 to 80 percent by weight and cerium octoate in a range of about 10 to 100 percent by weight or about 20 to 40 percent by weight. The combustion modifier can also include diborylated ferrocene in a range of about 15 to 85, about 35 to 75, or about 65 to 75 percent by weight and cerium octoate in a range of about 15 to 85, about 25 to 65, or about 25 to 35 percent by weight. The combustion rate and combustion efficiency are most improved when the combustion modifier contains about 70 percent by weight diborylated ferrocene and about 30 percent by weight cerium octoate. This embodiment of the composition is preferred because of the high combustion efficiency and combustion rate achieved by use of the combustion modifier during testing.

In the most preferred embodiments, the combustion modifier can be a mixture of diborylated ferrocene and cerium ammoniate or a mixture of diborylated ferrocene and cerium ureate. The mixtures of compounds contained in these embodiments of the composition may reduce nitrogen oxide emissions produced by combustion of the fuel. These embodiments of the composition are most preferred because, during testing, these embodiments of the combustion modifier achieved the highest combustion efficiency and combustion rates. The combustion modifier may include diborylated ferrocene in a range of about 10 to 100 percent by weight or about 60 to 80 percent by weight and either cerium ammoniate or cerium ureate in a range of about 10 to 100 percent by weight or about 20 to 40 percent by weight. The combustion rate and combustion efficiency are most improved when the combustion modifier contains about 70 percent by weight diborylated ferrocene and about 30 percent by weight cerium ammoniate or cerium ureate. In other embodiments, the combustion modifier may include diborylated ferrocene in a range of about 15 to 85, about 40 to 60, about 35 to 75, or about 65 to 75 percent by weight with the remainder of the composition including either cerium ammoniate or cerium ureate in a range of about 15 to 85, about 40 to 60, about 25 to 65, or about 25 to 35 percent by weight.

In an alternate embodiment of the invention, the combustion modifier can include a mixture of diborylated ferrocene and both cerium ammoniate and cerium ureate. In this embodiment, the combustion modifier can include diborylated ferrocene in a range of about 10 to 100 percent by weight or about 60 to 80 percent by weight and a mixture of both cerium ammoniate and cerium ureate in a range of about 10 to 100 percent by weight or about 20 to 40 percent by weight. The mixture of cerium ammoniate and cerium ureate may contain cerium ammoniate in a range of about 0.001 to 99.999 percent by weight and cerium ureate in a range of about 0.001 to 99.999 percent by weight. In other embodiments, the combustion modifier can include diborylated ferrocene in a range of about 15 to 85, about 40 to 60, about 35 to 75, or about 65 to 75 percent by weight with the remainder of the composition including a mixture of both cerium ammoniate and cerium ureate in a range of about 15 to 85, about 40 to 60, about 25 to 65, or about 25 to 35 percent by weight. The combustion rate and combustion efficiency are most improved when the combustion modifier contains about 70 percent by weight diborylated ferrocene and about 30 percent by weight of the mixture of cerium ammoniate and cerium ureate.

The combustion modifier may be a solid in the form of a pill, caplet, tablet, powder, bar, block, or amorphous form. The combustion modifier may also be manufactured as a liquid or gel. In one embodiment, the combustion modifier can be manufactured to include nanophase particles of the organometallic soap.

To produce the combustion modifier as a liquid, the organometallic soap can be dissolved in a solvent blend comprising Solvent 142, dibasic ester, and propylene glycol mono-n-butyl ether. Solvent 142 is a heavy hydrotreated petroleum with a flashpoint above 142 degrees Fahrenheit, which includes a mixture of predominantly aliphatic hydrocarbons (for example, paraffins and cycloparaffins) having hydrocarbon chain lengths predominantly in the range of C9 through C12. In other embodiments, the solvent blend may include about 0.1 to 10, about 3 to 7, about 3.5 to 5, or about 4 to 6 percent by weight organometallic soap; about 70 to 90, about 75 to 85, about 77 to 83, or about 80 to 82 percent by weight Solvent 142; about 5 to 15, about 7 to 11, or about 8.5 to 10 percent by weight dibasic ester; and about 1 to 10, about 4 to 6, or about 4.5 to 5.5 percent by weight propylene glycol mono-n-butyl ether. In another embodiment, the solvent blend may include about 2 to 8 percent by weight organometallic soap, about 73 to 89 percent by weight Solvent 142, about 6 to 12 percent by weight dibasic ester, and about 3 to 7 percent by weight propylene glycol mono-n-butyl ether. In an exemplary embodiment, the blend may include about 4 percent by weight organometallic soap, about 81 percent by weight Solvent 142, about 10 percent by weight dibasic ester, and about 5 percent by weight propylene glycol mono-n-butyl ether.

Method for Making

The invention features methods for making a combustion modifier that can be introduced into a fuel tank feeding an internal combustion engine to improve the efficiency of fuel combustion in the internal combustion engine. In one step of the method, cerium can be mixed and reacted with a synthetic mono-carboxylic acid and with a salt or ester of a second acid, e.g., 2-ethylhexanoic acid, octoic acid, stearic acid, naphthenic acid, salicylic acid, carbonic acid, or nitric acid. Other cerium-containing compounds can be substituted for the elemental cerium for reaction with the mono-carboxylic acid. Other acids and acid blends, including natural mono-carboxylic acids, can also be used to produce less effective combustion modifier compositions.

In another embodiment, a salt of ammonia or urea or an ester of ammonia or urea may be substituted in place of the salt or ester of the second acid.

In another embodiment of the method, the second acid, e.g., 2-ethylhexanoic acid, may itself be reacted with cerium in place of the salt or ester of the second acid. In this embodiment, if the second acid utilized for the reaction with cerium is a carboxylic acid, such as 2-ethylhexanoic acid, octoic acid, stearic acid, naphthenic acid, or salicylic acid, the addition of a mono-carboxylic acid is not required.

The cerium-containing compound and acid are heated and mixed in a reactor to form a mixture that may include any of the following cerous organometallic soap compounds: cerium-2-ethylhexanoate, cerium octoate, cerium stearate, cerium naphthenate, cerium salicylate, cerium carbonate, cerium ammoniate, cerium ureate, cerium nitrate, and combinations thereof.

In another step of the method, a ferric compound (e.g., ferric octoate, ferric-2-ethylhexanoate, ferric stearate, ferric naphthenate, ferric salicylate, ferric carbonate, diborylated ferrocene, n-butyl ferrocene, 1,1'-dimethyl ferrocene, benzoyl ferrocene, or combinations thereof) can be added to the mixture.

In another step of the method, the mixture is placed under a pressure of about 20 inches of mercury (e.g., 15, 18, 19, 19.5, 19.9, 20, 20.1, 20.5, 21, 22, or 25 inches of mercury) while heat continues to be applied. Then, the mixture is placed under a pressure of about 30 inches of mercury (e.g., 25, 28, 29, 29.5, 29.9, 29.92, 30, 30.1, 30.5, 31, 32, or 35 inches of mercury) while continuing to be heated.

In another step of the method, the mixture undergoes cooling prior to packaging to yield a combustion modifier.

Method for Using

The invention also features methods for improving the efficiency of fuel combustion in an internal combustion engine. In one embodiment of the method, a composition containing a mixture of a hydrocarbon fuel and a combustion modifier containing an organometallic soap is introduced into a fuel tank feeding an internal combustion engine. In an exemplary embodiment of the method, the combustion modifier is introduced into the fuel tank of the internal combustion engine through a fuel line.

In another embodiment of the method, the combustion modifier may be premixed with the hydrocarbon fuel and subsequently introduced into the fuel tank of the internal combustion engine. In another embodiment of the method, the combustion modifier may be introduced into the fuel tank, directly into the combustion chamber, or into both the fuel tank and combustion chamber using a pump or another suitable system for supplying the combustion modifier into the internal combustion engine.

The internal combustion engine into which the combustion modifier is introduced can be a reciprocating engine (e.g., a diesel engine, a two-stroke engine, a four-stroke engine, a five-stroke engine, a six-stroke engine, a crude oil engine, a hot bulb engine, a controlled combustion engine, or a Bourke engine), a rotary engine (e.g., a Wankel engine), or a continuous combustion engine (e.g., a gas turbine, a jet engine, or a rocket engine). The internal combustion engine may use any suitable form of combustion such as homogeneous charge spark ignition, stratified charge compression ignition, or homogeneous charge compression ignition. In one embodiment, the fuel tank into which the composition is introduced may be part of a vehicle such as an automobile, a truck, a motorcycle, an aircraft, a personal watercraft, a boat, a bus, an all-terrain vehicle (ATV), a motorized go-cart, a motorized bicycle, a tractor, a lawn mower, a locomotive, an engineering vehicle, or a scooter. In another embodiment the fuel tank into which the composition is introduced can be part of a generator.

In one embodiment of the method, the combustion modifier is supplied into the fuel tank in an amount of about 0.01 to 5 grams (e.g., 0.01, 0.05, 0.1, 0.5, 1, 1.5, 2, 3, 4, 4.9, 5, or 5.5 grams) per about 20 gallons of fuel.

In an exemplary embodiment of the method, the combustion modifier is supplied into the fuel tank in an amount of about 0.01 to 3 grams (e.g., 0.01, 0.05, 0.1, 0.5, 1, 1.5, 2, 2.9, 3, or 3.5 grams) per about 20 gallons of fuel.

In a preferred embodiment of the method, the combustion modifier is supplied into the fuel tank in an amount of about 0.25 to 1 gram (e.g., 0.1, 0.3, 0.5, 0.9, 1, 1.1, or 1.5 grams) per about 20 gallons of fuel.

EXAMPLE

By adding the combustion modifier to the fuel in an automobile or other vehicle's internal combustion engine, the combustion efficiency of that internal combustion engine may be significantly improved. During testing, diesel fuel was combusted in an internal combustion engine first without the introduction of the combustion modifier (the control test shown in FIGS. 1A and 1B) and then with the introduction of the combustion modifier (the experimental test shown in FIGS. 2A and 2B). The combustion modifier used in the experimental test was a mixture of 70 percent by weight diborylated ferrocene and 30 percent by weight cerium-2-ethylhexanoate. The fuel pounds per hour combusted by the internal combustion engine was measured and the air/fuel ratio was calculated from the amounts of air and fuel used in a given time period. The internal combustion engine was operated at the same horsepower during both tests and measurements were taken at intervals of about one to two minutes.

In the control test, diesel fuel was burned in an internal combustion engine in the absence of the combustion modifier. Approximately 10.8 to 11.1 fuel pounds per hour of diesel fuel were combusted by the internal combustion engine in the absence of the combustion modifier. The air/fuel ratio for the control test fell within a range of about 52 to about 54.

Figure 1B:
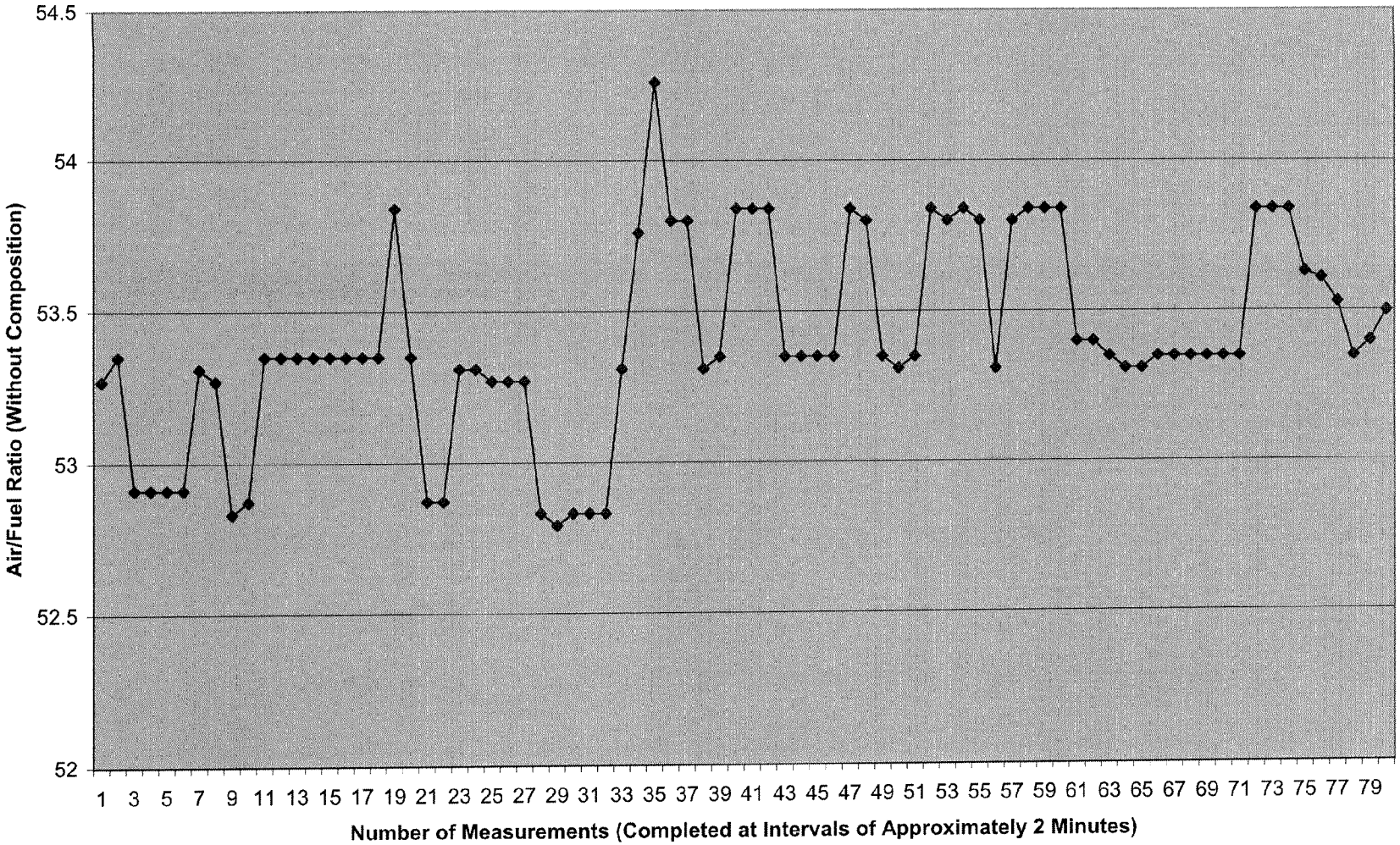
FIG. 1B is a chart representing measurements of air consumed by fuel combustion for a control test in which diesel fuel was combusted in the internal combustion engine without the addition of a combustion modifier of the invention.
Figure 2A:
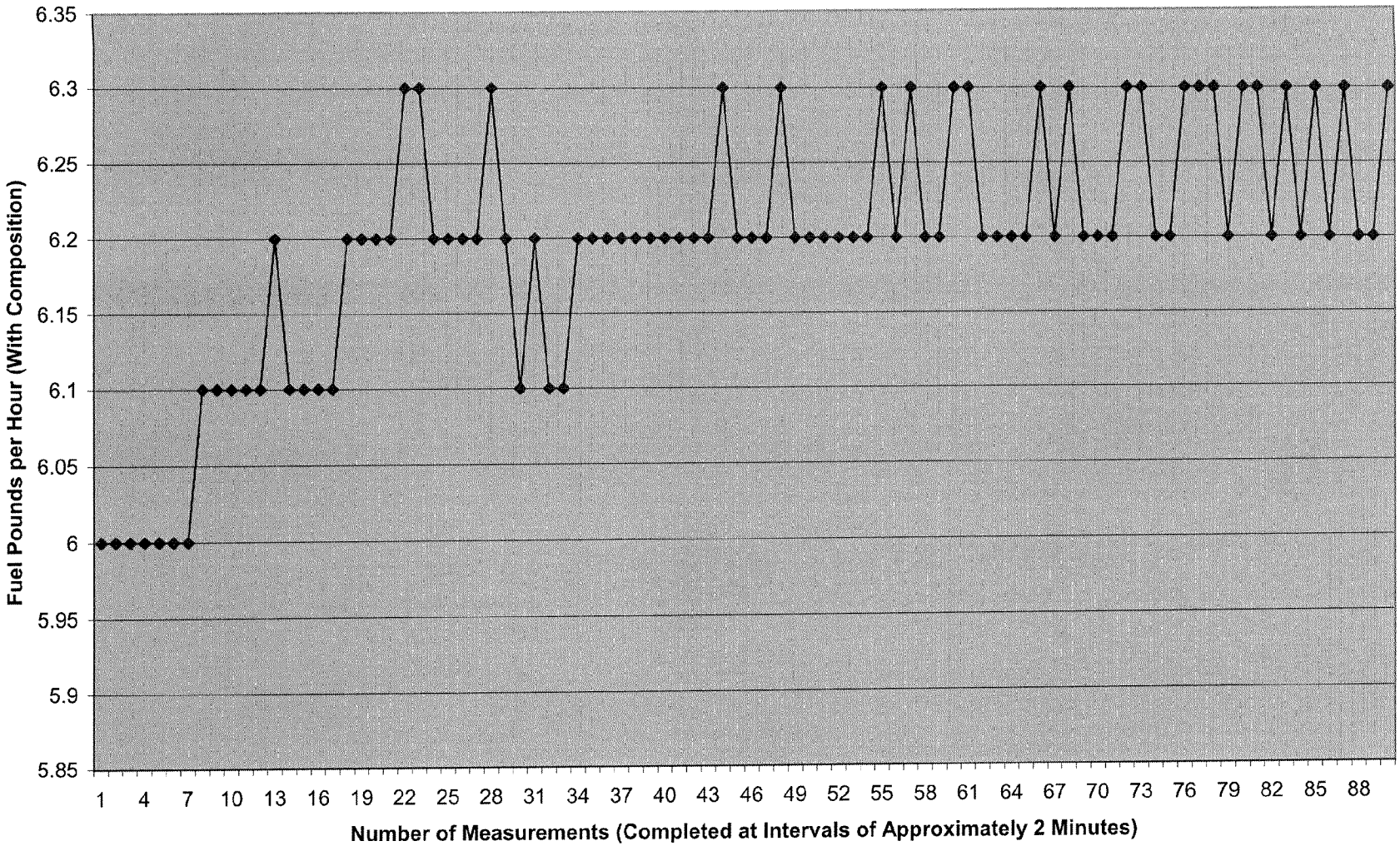
FIG. 2A is a chart representing fuel pounds per hour measurements for an experimental test in which diesel fuel was combusted in an internal combustion engine to which a combustion modifier of the invention was supplied.
Figure 2B:
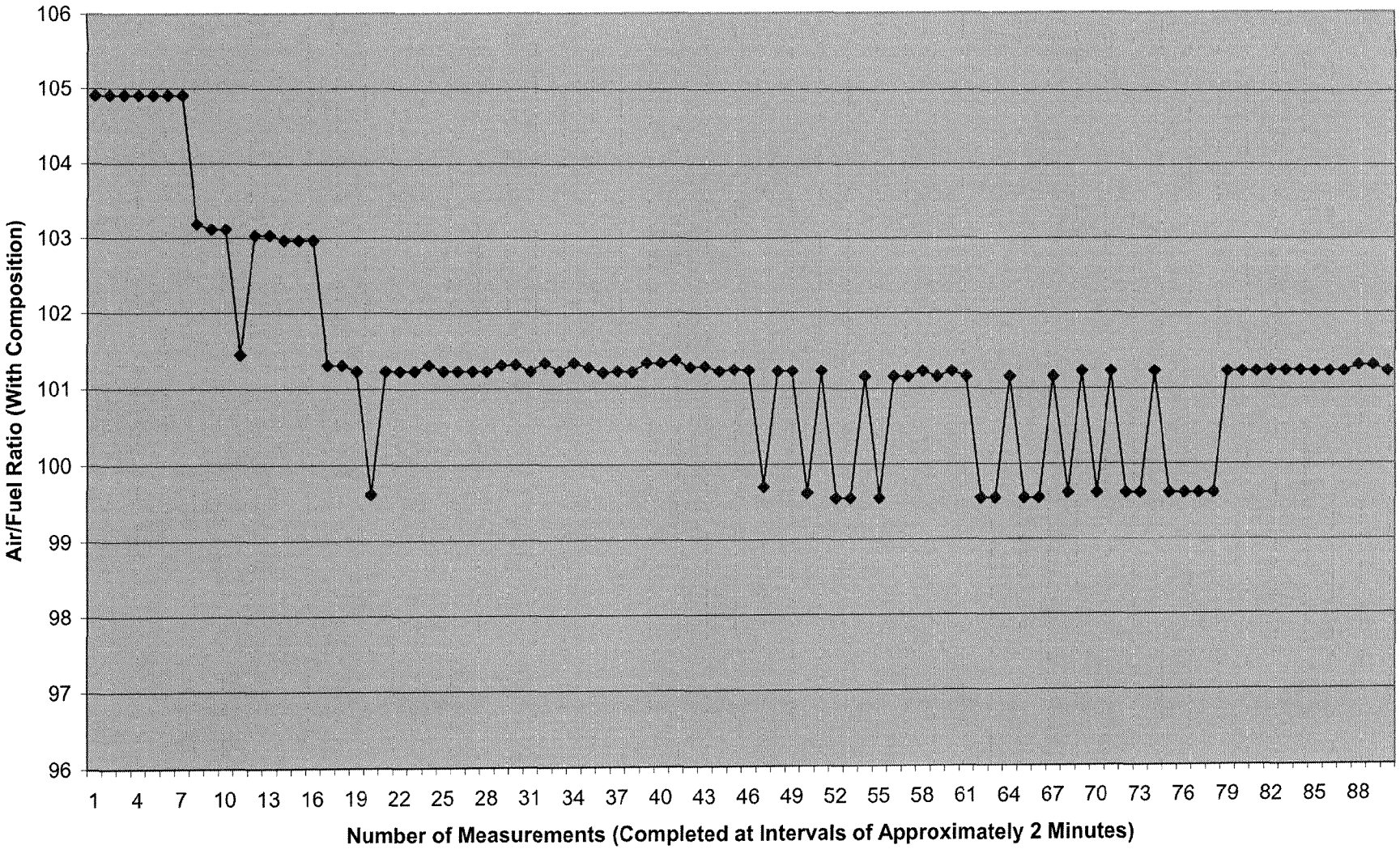
FIG. 2B is a chart representing measurements of air consumed by fuel combustion for an experimental test in which diesel fuel was combusted in the internal combustion engine to which a combustion modifier of the invention was supplied.

In the experimental test, the combustion modifier was added to diesel fuel supplied to an internal combustion engine and the fuel pounds per hour was measured and the air/fuel ratio calculated. As shown in FIGS. 1A and 1B, approximately 6.0 to 6.3 fuel pounds per hour were combusted by the internal combustion engine to which the combustion modifier was supplied. The air/fuel ratio in this experimental test fell within a range of about 99 to about 105. The amount of fuel combusted by the internal combustion engine in the presence of the combustion modifier was about 40 percent less than the amount of fuel combusted by the engine during the control test.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A composition for improving the combustion efficiency of an internal combustion engine in combusting hydrocarbon fuels, the composition comprising:

a hydrocarbon fuel and a combustion modifier, the combustion modifier comprising:

an organometallic soap comprising diborylated ferrocene.

2. The composition of claim 1, wherein the organometallic soap further comprises a compound selected from the group consisting of: cerium octoate, cerium ammoniate, cerium ureate, and cerium-2-ethylhexanoate.

3. The composition of claim 1, wherein the combustion modifier comprises a mixture of diborylated ferrocene and a compound selected from the group consisting of: cerium-2-ethylhexanoate and cerium octoate.

4. The composition of claim 1, wherein the combustion modifier comprises a mixture of diborylated ferrocene and a compound selected from the group consisting of: cerium ammoniate and cerium ureate.

5. The composition of claim 1, wherein the combustion modifier comprises diborylated ferrocene in the range of 10 to 100 percent by weight.

6. The composition of claim 1, wherein the combustion modifier further comprises cerium-2-ethylhexanoate.

7. The composition of claim 1, wherein the combustion modifier comprises a mixture of 70 percent by weight diborylated ferrocene and 30 percent by weight cerium-2-ethylhexanoate.

8. The composition of claim 1, wherein the combustion modifier comprises a mixture of diborylated ferrocene at 70 percent by weight and 30 percent by weight of an organometallic soap selected from the group consisting of cerium ammoniate and cerium ureate.

9. The composition of claim 1, wherein the combustion modifier is a liquid.

10. The composition of claim 9, wherein the organometallic soap is dissolved in a solvent blend comprising Solvent 142, dibasic ester, and propylene glycol mono n-butyl ether.

11. The composition of claim 10, wherein the combustion modifier comprises about 4 percent by weight organometallic soap, about 81 percent by weight Solvent 142, about 10 percent by weight dibasic ester, and about 5 percent by weight propylene glycol mono-n-butyl ether.

12. The composition of claim 1, wherein the combustion modifier comprises a mixture of diborylated ferrocene at 40 to 60 percent by weight and a cerous compound at 40 to 60 percent by weight wherein the cerous compound is selected from one of the group consisting of cerium ammoniate and cerium ureate.

13. A method comprising the step of:

introducing into an internal combustion engine a hydrocarbon fuel and a combustion modifier, the combustion modifier comprising:

an organometallic soap comprising diborylated ferrocene and another compound selected from the group consisting of: cerium-2-ethylhexanoate, cerium octoate, cerium stearate, cerium naphthenate, cerium salicylate, cerium carbonate, cerium ammoniate, cerium ureate, cerium nitrate, ferric octoate, ferric-2-ethylhexanoate, ferric stearate, ferric naphthenate, ferric salicylate, ferric carbonate, n-butyl ferrocene, 1,1-dimethyl ferrocene, benzoyl ferrocene, and combinations thereof.

14. The method of claim 13, wherein the combustion modifier is supplied into a fuel tank connected to the internal combustion engine in an amount of about 0.01 to 5 grams per about 20 gallons of fuel.

15. The method of claim 13, wherein the combustion modifier is supplied into a fuel tank connected to the internal combustion engine in an amount of about 0.01 to 3 grams per about 20 gallons of fuel.

16. The method of claim 13, wherein the combustion modifier is supplied into a fuel tank connected to the internal combustion engine in an amount of about 0.25 to 1 gram per about 20 gallons of fuel.

17. The composition of claim 1, wherein the organometallic soap further comprises a compound selected from the group consisting of:

cerium-2-ethylhexanoate, cerium octoate, cerium stearate, cerium naphthenate, cerium salicylate, cerium carbonate, cerium ammoniate, cerium ureate, cerium nitrate, ferric octoate, ferric-2-ethylhexanoate, ferric stearate, ferric naphthenate, ferric salicylate, ferric carbonate, n-butyl ferrocene, 1,1'-dimethyl ferrocene, benzoyl ferrocene, and combinations thereof.

* * * * *